US006717371B2

(12) United States Patent
Klier et al.

(10) Patent No.: US 6,717,371 B2
(45) Date of Patent: Apr. 6, 2004

(54) BALLAST FOR OPERATING AT LEAST ONE LOW-PRESSURE DISCHARGE LAMP

(75) Inventors: Juergen Klier, Traunreut (DE); Rene Twardzik, Traunreut (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 0 days.

(21) Appl. No.: 10/195,362

(22) Filed: Jul. 16, 2002

(65) Prior Publication Data

US 2003/0015974 A1 Jan. 23, 2003

(30) Foreign Application Priority Data

Jul. 23, 2001 (DE) ..... 101 34 966

(51) Int. Cl.[7] ..... H05B 41/16

(52) U.S. Cl. ..... 315/274; 315/276; 315/282; 315/312

(58) Field of Search ..... 315/276, 277, 315/282, 279, 274, 246, 250, 291, 307, 312, 324

(56) References Cited

U.S. PATENT DOCUMENTS

| | | | | |
|---|---|---|---|---|
| 4,392,085 A | | 7/1983 | Knoll et al. | 315/173 |
| 4,574,222 A | * | 3/1986 | Anderson | 315/254 |
| 5,636,111 A | * | 6/1997 | Griffin et al. | 363/37 |
| 6,232,726 B1 | * | 5/2001 | Janczak | 315/224 |

OTHER PUBLICATIONS

PCT WO 94/15444 Jul. 7, 1994.*

* cited by examiner

*Primary Examiner*—Don Wong
*Assistant Examiner*—Tuyet T. Vo

(57) ABSTRACT

The invention relates to a ballast for operating at least one low-pressure discharge lamp, preferably a three- or four-lamp ballast. In order for all parallel- or series-connected low-pressure discharge lamps (L40–L43) to shine equally bright even in the case of strong dimming, the ballast according to the invention has a transformer (Tr40) for balancing the currents in the lamp branch circuits and a transformer (Tr41) for compensating the losses owing to parasitic capacitances.

11 Claims, 4 Drawing Sheets

BALLAST FOR OPERATING AT LEAST ONE LOW-PRESSURE DISCHARGE LAMP

TECHNICAL FIELD

The invention relates to a ballast for operating at least one low-pressure discharge lamp.

BACKGROUND ART

U.S. Pat. No. 4,392,085 discloses a ballast for operating two parallel-connected low-pressure discharge lamps on a half-bridge inverter. The ballast has a transformer with two similar windings that are each connected to one of the two lamp branch circuits. This transformer operates as a differential current transformer. If one of the two lamps ignites earlier than the other, the ignition of the other lamp is supported with the aid of the transformer.

DISCLOSURE OF THE INVENTION

The problem frequently arises in the case of ballasts for operating a plurality of low-pressure discharge lamps that the lamps shine with a different brightness in the dimming mode. If the lamps are arranged in different, parallel-connected branch circuits, this problem can be caused by different currents in the branch circuits. On the other hand, however, this problem also occurs with lamps that—as in the case of a series connection of two lamps—are arranged in the same branch circuit. In particular, when the ballast has an inverter that is provided with a downstream load circuit designed as a resonant circuit, in which the lamps are connected, those lamps that are directly connected to the resonant circuit components frequency shine more brightly than the downstream lamps. In addition, it may be observed that when only one low-pressure discharge lamp is operated in each branch circuit the two ends of the lamp shine with a different brightness. These brightness differences become more obvious the stronger the lamps are dimmed. For the abovementioned reasons, in the case of conventional operating devices or ballasts, in particular for the series connection of a plurality of low-pressure discharge lamps, the lower dimming stage or brightness stage is limited to approximately 10% of a maximum brightness. The aforesaid problems are caused by parasitic capacitances between the lamp or the lamp leads and the luminaire and also by parasitic capacitances inside the heating circuit.

It is the object of the invention to provide a ballast in the case of which the above-named problems no longer occur.

This object is achieved by the means of a ballast having the features of patent claims 1, 2, 4 or 7. Particularly advantageous embodiments of the invention are disclosed in the dependent patent claims.

For low-pressure discharge lamps that are arranged in three parallel-connected branch circuits, the object is achieved by means of a ballast having the features of patent claim 1 or, alternatively, having the features of patent claim 2. For low-pressure discharge lamps that are arranged in two parallel-connected branch circuits, the object of the invention is achieved by means of a ballast having the features of patent claim 4. For low-pressure discharge lamps that are arranged in the same branch circuit, that is to say for a series connection of a plurality of low-pressure discharge lamps, or for the operation of a single low-pressure discharge lamp, the object of the invention is achieved by means of a ballast having the features of patent claim 7.

In accordance with a first variant of the invention, the ballast has three parallel-connected branch circuits to which in each case electric terminals for at least one low-pressure discharge lamp are connected. Moreover, this ballast has the following further features:

- a transformer for balancing the lamp currents, the transformer having a first and a second winding, and the first winding having twice as many turns as the second winding,
- a second transformer for balancing the lamp currents, the second transformer having a first and second winding, and the first winding having twice as many turns as the second winding,
- the windings of the transformers being arranged in such a way that when the low-pressure discharge lamps are connected the lamp currents flow firstly through the windings of one of the two transformers, then through the low-pressure discharge lamps and only then through the windings of the other transformer,
- the first winding of the first transformer being arranged in such a way that when the low-pressure discharge lamps are connected it is flowed through by the lamp current of the low-pressure discharge lamp or low-pressure discharge lamps connected to the first branch circuit,
- the second winding of the first transformer being arranged in such a way that, with the low-pressure discharge lamps connected, it is flowed through by the lamp currents of the low-pressure discharge lamps connected to the second and third branch circuit, the two windings of the first transformer being wound in opposite senses,
- the first winding of the second transformer being arranged in such a way that, with the low-pressure discharge lamps connected, it is flowed through by the lamp current of the low-pressure discharge lamp or low-pressure discharge lamps connected to the third branch circuit, and
- the second winding of the second transformer being arranged in such a way that, with the low-pressure discharge lamps connected, it is flowed through by the lamp currents of the low-pressure discharge lamps connected to the first and second branch circuit, the two windings of the second transformer being wound in opposite senses.

This variant of the invention is particularly well suited for operating three parallel-connected low-pressure discharge lamps. It is distinguished by a particularly simple wiring of the luminaire. The two transformers act like a differential current transformer owing to the arrangement of their first and second windings in opposite senses. Owing to the special turn ratio of 2:1 between the first and second windings for both transformers, it is ensured that all three branch circuits are of balanced design, since the second windings of the two transformers are flowed through by the partial currents of two branch circuits. However, owing to the special arrangement of the windings of the two transformers, it is ensured that the currents in the three branch circuits are balanced, on the one hand, and also that the losses owing to parasitic capacitances in each individual branch circuit or in each individual lamp are compensated, on the other hand. Consequently, all three lamps shine with the same brightness even in the event of strong dimming.

In accordance with a second variant of the invention, the ballast has three parallel-connected branch circuits to which electric terminals for at least one low-pressure discharge lamp are connected in each case. Moreover, this ballast has a transformer with three identically constructed and isotropically arranged windings that are arranged in each case in one of the branch circuits such that they are flowed through by the lamp current in the same sense. In this context, isotropic means that the transformer is equipped with a three-limb core and three identical windings, one winding being arranged on each limb. These windings are arranged in this case in the branch circuits in such a way that they are flowed through by the lamp current in the same sense. Owing to this arrangement of the windings, and to the identical design of the limbs, magnetic flux induced through each winding is distributed uniformly over the other limbs. A change in the current in one of the three branch circuits therefore automatically effects a corresponding change in the current in the two other branch circuits. If more than one low-pressure discharge lamp is arranged in one of the three branch circuits, for example a series connection composed of two low-pressure discharge lamps, the ballast is advantageously equipped with a second transformer for balancing the lamp current, the two windings of this second transformer having the same number of turns per unit length and being connected upstream and downstream of the parallel connection of the three branch circuits such that the windings are flowed through by the total current of the branch circuits in the opposite senses. This measure ensures that all the lamps that are arranged in the same branch circuit shine with the same brightness.

In accordance with a third variant of the invention, the ballast has the following features:

a transformer for balancing the lamp currents, two parallel-connected branch circuits to which electric terminals for at least one low-pressure discharge lamp are connected in each case, the transformer having a first winding that is connected to the first branch circuit, and having a second winding with the same number of turns that is connected to the second branch circuit with the opposite winding sense, a second transformer for balancing the lamp currents, the second transformer having a first and a second winding with the same number of turns per unit length, the first winding being arranged upstream of the parallel connection of the branch circuits, and the second winding being arranged downstream of the parallel connection of the branch circuits, and the first and the second windings of the second transformer being arranged in such a way that, with the low-pressure discharge lamps connected, they are flowed through in the opposite sense by the total current of the parallel connection of the branch circuits.

Both transformers act as differential current transformers. The first transformer ensures balancing of the currents in the two parallel-connected branch circuits, while the second transformer causes balancing of the total current upstream and downstream of the parallel connection of the branch circuits. The first transformer ensures that the lamps in the two branch circuits shine with the same brightness, while the second transformer ensures that the lamps arranged in the same branch circuit—that is to say the series-connected lamps of each branch circuit—shine with the same brightness. The second transformer compensates the losses that are produced by parasitic capacitances. In its attempt to cause equal currents to flow in its windings, it balances the leakage currents caused by parasitic capacitances. In this process, it lowers the potential of the lamp terminal assigned to the capacitor C1, while it correspondingly raises the potential of the lamp terminal assigned to the capacitor C2. This ballast is therefore particularly well suited for operating four low-pressure discharge lamps that are arranged in two parallel branch circuits with in each case a series connection composed of two low-pressure discharge lamps. This variant of the ballast is, however, also suitable for operating a different number of low-pressure discharge lamps in the two parallel-connected branch circuits. For example, it is possible to arrange two series-connected low-pressure discharge lamps in the first branch circuit, and to operate only one low-pressure discharge lamp in the second branch circuit.

In accordance with a fourth variant of the invention, the ballast has electric terminals for a single low-pressure discharge lamp, or electric terminals for a plurality of series-connected low-pressure discharge lamps. Moreover, this ballast has a transformer having two windings with the same number of turns per unit length, the first winding—with the low-pressure discharge lamp or the low-pressure discharge lamps connected—being connected directly upstream of the low-pressure discharge lamp or the series connection of the low-pressure discharge lamps, and the second winding being connected directly downstream of the low-pressure discharge lamp or the series connection of the low-pressure discharge lamps, such that the windings of the transformer are flowed through by the lamp current in opposite senses.

With the aid of this transformer and the arrangement, according to the invention, of its windings, it is ensured that the two ends of the low-pressure discharge lamp operated on the ballast shine with the same brightness even in the case of strong dimming, or that in the case of a series connection of a plurality of low-pressure discharge lamps, the low-pressure discharge lamps connected in series shine with the same brightness. The windings of the transformer cause a balancing of the current in the supply leads directly upstream and downstream of the low-pressure discharge lamp, or directly upstream and downstream of the series connection of the low-pressure discharge lamps. The losses owing to parasitic capacitances in the lamps are compensated by means of the transformer.

The ballast according to the invention is advantageously designed as an inverter with a downstream load circuit, the electric terminals for the low-pressure discharge lamps or the branch circuits with the electric terminals for at least one low-pressure discharge lamp being arranged in the load circuit, in order to be able to operate the lamps with the aid of a high-frequency alternating current. The operation of the lamps with the aid of a high-frequency alternating current improves the luminous efficiency and enables the brightness of the lamps to be controlled in a simple way by changing the frequency of the alternating current.

In accordance with the preferred exemplary embodiments of the invention, use is made of, in particular, a half-bridge inverter whose downstream load circuit is designed as a series resonant circuit. The design of the load circuit as a series resonant circuit permits the low-pressure discharge lamps to be ignited in a simple way by means of the method of resonance increase.

BRIEF DESCRIPTION OF THE DRAWINGS

The invention is explained in more detail below with the aid of a plurality of preferred exemplary embodiments. In the drawing.

BEST MODE FOR CARRYING OUT THE INVENTION

Figure 1:
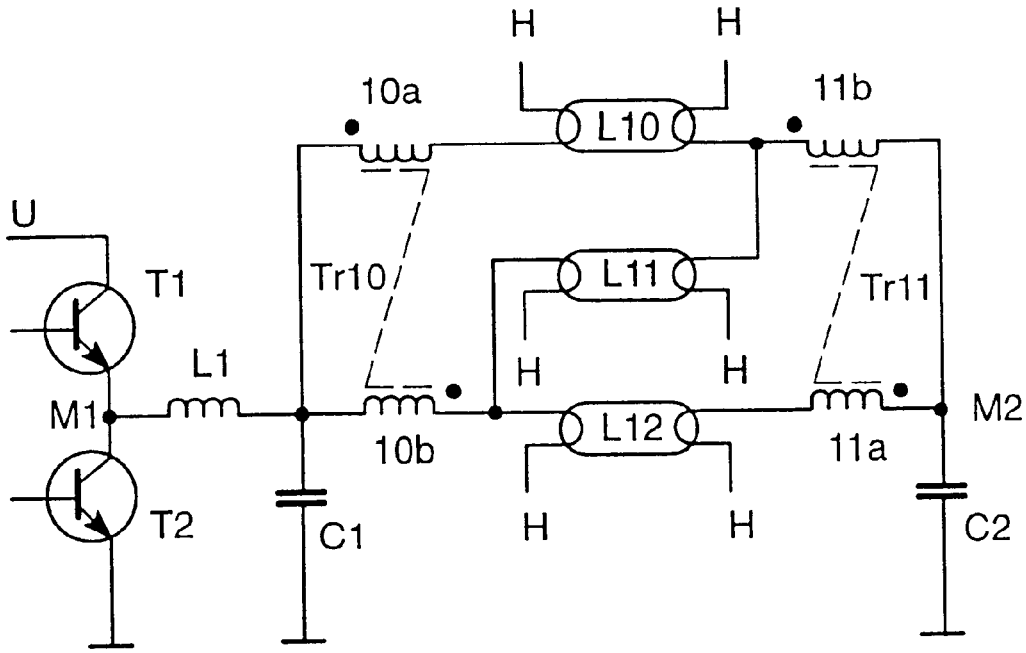
FIG. 1 shows a schematic of the circuit arrangement of a ballast in accordance with the first exemplary embodiment of the invention.
Figure 2:
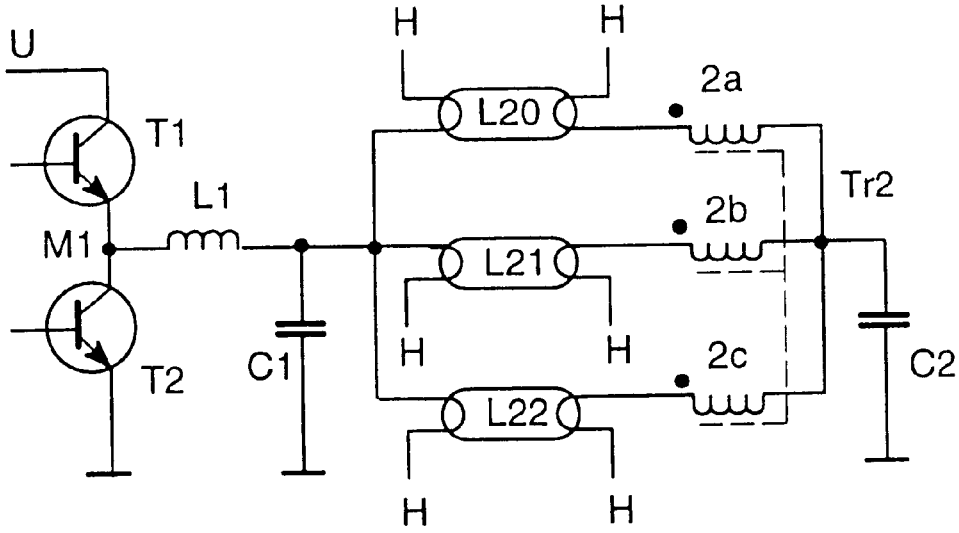
FIG. 2 shows a schematic of the circuit arrangement of a ballast in accordance with the second exemplary embodiment of the invention.
Figure 3:
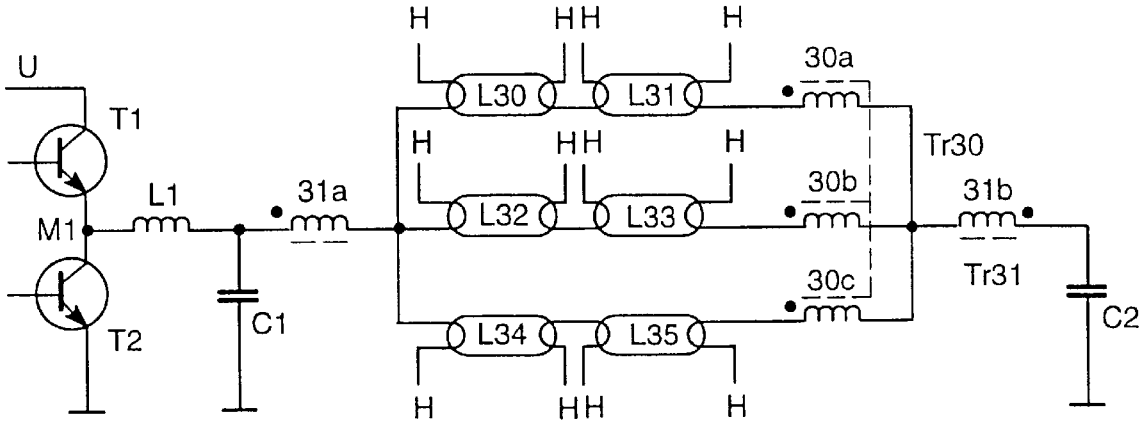
FIG. 3 shows a schematic of the circuit arrangement of a ballast in accordance with the third exemplary embodiment of the invention.
Figure 4:
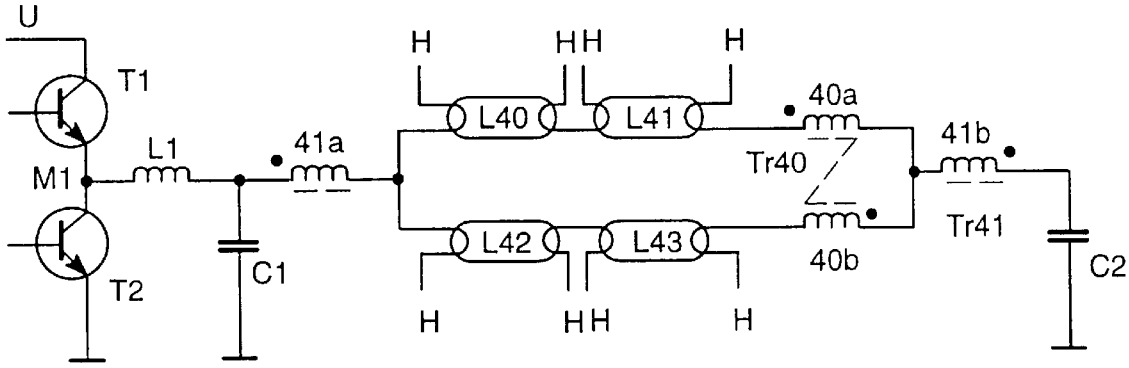
FIG. 4 shows a schematic of the circuit arrangement of a ballast in accordance with the fourth exemplary embodiment of the invention.
Figure 5:
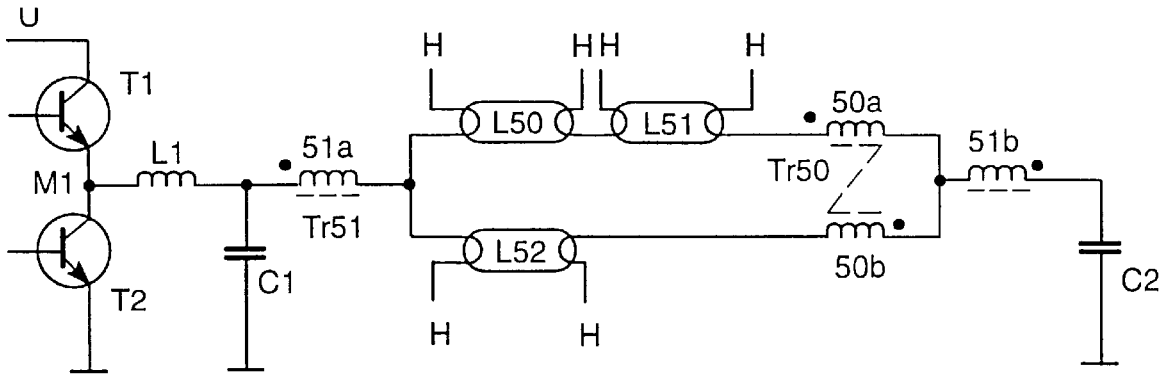
FIG. 5 shows a schematic of the circuit arrangement of a ballast in accordance with the fifth exemplary embodiment of the invention.
Figure 6:
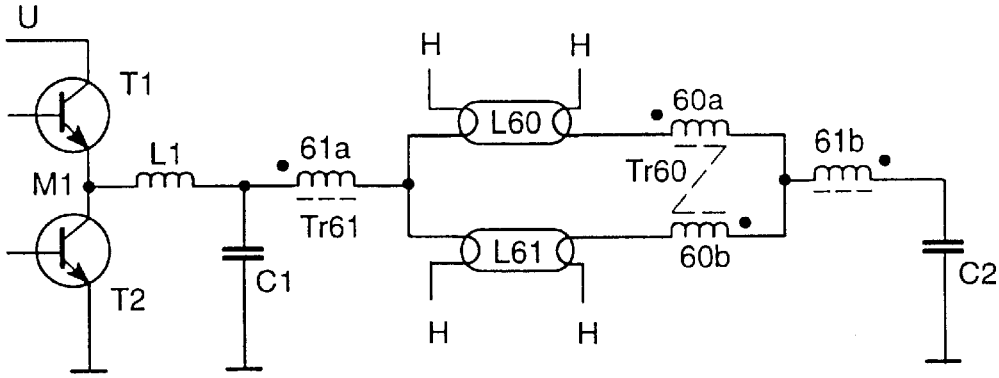
FIG. 6 shows a schematic of the circuit arrangement of a ballast in accordance with the sixth exemplary embodiment of the invention.
Figure 7:
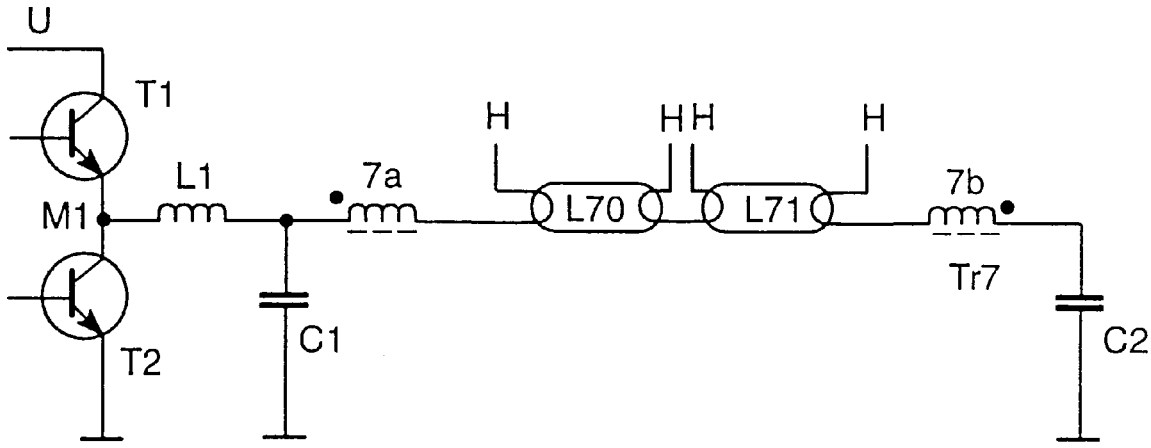
FIG. 7 shows a schematic of the circuit arrangement of a ballast in accordance with the seventh exemplary embodiment of the invention.
Figure 8:
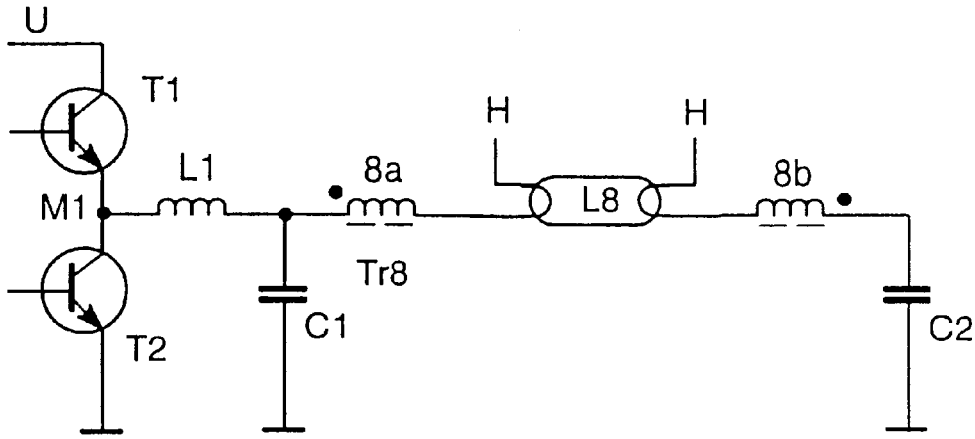
FIG. 8 shows a schematic of the circuit arrangement of a ballast in accordance with the eighth exemplary embodiment of the invention.

In FIGS. 1 to 8, the same reference symbols have been selected for identical components of the ballast or of the circuit arrangement. In the case of all exemplary embodiments of the invention, the ballast has a half-bridge inverter that essentially comprises the transistors T1, T2 and a drive device (not illustrated) for the transistors T1, T2, as well as the half-bridge capacitor C2. The half-bridge inverter T1, T2 is supplied at its voltage inputs with a DC voltage U that is generated in a known way by filtering and rectifying the AC supply voltage. The filter and rectifier circuits of the ballast are therefore not illustrated in the figures and are also not intended to be further described here. The inductor L1 is connected to the center tap M1 between the transistors T1, T2 of the half-bridge inverter. Connected to the inductor L1 is the first terminal of the capacitor C1, while the second terminal of the capacitor C1 is connected to frame potential. The inductor L1 and the capacitor C1 form a series resonant circuit. The first terminal of the resonance capacitor C1 is connected to the first terminal of the half-bridge capacitor C2 via a parallel connection of a plurality of low-pressure discharge lamps or a series connection of low-pressure discharge lamps or a combination of the two. The second terminal of the half-bridge capacitor C2 is at frame potential. Half the supply voltage U of the half-bridge inverter is present at the half-bridge capacitor C2. The transistors T1, T2 are switched by means of the drive device in a known way with a frequency of more than 20 kHz in an alternating fashion such that the center tap M1 is alternately connected to the frame potential and the positive potential U. Consequently, there flows between the center tap M1 and the second terminal of the half-bridge capacitor C2 a correspondingly high-frequency alternating current with the aid of which the low-pressure discharge lamps are operated. In the case of all exemplary embodiments, the ballast serves to operate low-pressure discharge lamps, in particular fluorescent lamps, that are provided in each case with two heatable electrode filaments for generating a gas discharge. Each electrode filament has two electric terminals which can be used to supply the electrode filament with a heating current in a known way by means of a heating device H (not illustrated), in order to enable the lamp to be operated with care. The electric terminals of the electrode filaments or the low-pressure discharge lamps that are connected to the heating device H are provided correspondingly with the reference symbol H in FIGS. 1 to 8. Since the heating device H is known and plays no role in the present invention, it is not further explained here. All eight exemplary embodiments correspond to this extent.

In accordance with the first exemplary embodiment of the invention, the ballast serves to operate three parallel-connected low-pressure discharge lamps, in particular fluorescent lamps L10, L11, L12. The circuit arrangement of this ballast is illustrated schematically in FIG. 1. Connected to the first terminal of the resonance capacitor C1 and to the first terminal of the half-bridge capacitor C2 are three parallel-connected branch circuits to which a low-pressure discharge lamp L10 or L11 or L12 is respectively connected. Moreover, this ballast has two transformers Tr10, Tr11 with two windings 10*a*, 10*b*, 11*a*, 11*b* respectively. The turn ratio of the windings 10*a*, 10*b* of the first transformer Tr10 is 2:1. The turn ratio of the windings 11*a*, 11*b* of the second transformer Tr11 is likewise also 2:1. The winding 10*a* of the transformer Tr10 is connected to the first current path, in series with the fluorescent lamp L10. The second winding 10*b* of the transformer Tr10 is connected both to the second current path, in series with the fluorescent lamp L11, and to the third current path, in series with the fluorescent lamp L12. The winding 10*a* is therefore flowed through by the discharge current of the fluorescent lamp L10, while the winding 10*b* is flowed through by the discharge currents of the fluorescent lamps L11 and L12. The two windings 10*a*, 10*b* are wound in opposite senses such that they are flowed through by the discharge current of the lamps in opposite senses. In a similar way, the first winding 11*a* of the transformer Tr11 is connected to the third current path, in series with the fluorescent lamp L12, while the second winding 11*b* is connected both to the first current path, in series with the fluorescent lamp L10, and to the second current path, in series with the fluorescent lamp L11. The winding 11*a* is therefore flowed through by the discharge current of the fluorescent lamp L12, while the winding 11*b* is flowed through by the discharge currents of the fluorescent lamps L10 and L11. The windings 11*a*, 11*b* are arranged in opposite senses such that they are flowed through in opposite senses by the discharge currents or lamp currents. The first transformer Tr10 is connected directly upstream of the fluorescent lamps L10 to L12, while the second transformer Tr11 is connected directly downstream of the fluorescent lamps L10 to L12. All three current paths are therefore of completely symmetrical design. The two transformers Tr10, Tr11 act in each case as differential current transformers and ensure that all three lamps shine equally brightly independently of the dimming stage.

In accordance with the second exemplary embodiment of the invention, the ballast serves to operate three parallel-connected low-pressure discharge lamps, in particular fluorescent lamps L20, L21, L22. The circuit arrangement of this ballast is illustrated schematically in FIG. 2. Connected to the first terminal of the resonance capacitor C1 and to the first terminal of the half-bridge capacitor C2 are three parallel-connected branch circuits to which a low-pressure discharge lamp L20 or L21 or L22 is connected in each case. Moreover, this ballast has a transformer Tr2 with three identically constructed and isotropically arranged windings 2*a*, 2*b*, 2*c*. One of the fluorescent lamps L20 or L21 or L22 is connected to each of the three parallel-connected branch circuits, and one of the windings 2*a* or 2*b* or 2*c* is connected in series with the discharge path of the corresponding fluorescent lamp L20 or L21 or L22. The windings 2*a*, 2*b*, 2*c* of the transformer Tr2 are arranged in the respective branch circuit such that they are flowed through by the discharge currents of the lamps in the same sense.

In accordance with the third exemplary embodiment of the invention, the ballast serves to operate six low-pressure discharge lamps, in particular fluorescent lamps L30, L31, L32, L33, L34, L35. The circuit arrangement of this ballast is illustrated schematically in FIG. 3. Connected to the first terminal of the resonance capacitor C1 and to the first terminal of the half-bridge capacitor C2 are three parallel-connected branch circuits to which in each case two series-connected low-pressure discharge lamps L30 and L31 or L32 and L33 or L34 and L35 are connected. The ballast also has a transformer Tr30 with three identical and isotropically arranged windings 30*a*, 30*b*, 30*c*. One of these windings 30*a* or 30*b* or 30*c* is connected to each of the three branch circuits in series with the series connection of the corresponding two fluorescent lamps L30 and L31 or L32 and L33 or L34 and L35, such that the windings 30*a*, 30*b*, 30*c* are flowed through by the partial currents of the branch circuits in the same sense. Furthermore, the ballast has a second transformer Tr31 with two similar windings 31*a*, 31*b*. The first winding 31*a* is arranged directly upstream of the parallel connection, comprising three branch circuits, of the lamps, and the second winding 31*b* is arranged directly downstream of the parallel connection, comprising the three branch circuits, of the lamps, specifically such that the two windings 31*a*, 31*b* are flowed through by the total current of the three branch circuits in opposite senses.

In accordance with the fourth exemplary embodiment of the invention, the ballast serves to operate four low-pressure discharge lamps, in particular fluorescent lamps L40, L41, L42, L43. The circuit arrangement of this ballast is illustrated schematically in FIG. 4. Connected to the first terminal of the resonance capacitor C1 and to the first terminal of the half-bridge capacitor C2 are two parallel-connected branch circuits to which two series-connected low-pressure discharge lamps L40 and L41 or L42 and L43 are connected in each case. Moreover, the ballast has a transformer Tr40 with two windings 40*a*, 40*b* with the same number of turns per unit length. The first winding 40*a* is connected to the first branch circuit, in series with the series connection of the low-pressure discharge lamps L40 and L41. The second winding 40*b* is connected to the second branch circuit, in series with the series connection of the low-pressure discharge lamps L42 and L43. The two windings 40*a*, 40*b* are arranged in the branch circuits such that they are flowed through in opposite directions by the discharge currents of the lamps or the partial currents in the branch circuits. The transformer Tr40 acts as a differential current transformer and ensures a balancing of the partial currents in the two parallel-connected branch circuits. The ballast further has a second transformer Tr41 with two windings 41*a*, 41*b* with the same number of turns per unit length. The first winding 41*a* is connected directly upstream of the parallel connection of the two branch circuits, and the second winding 41*b* is connected directly downstream of the parallel connection of the two branch circuits, such that the two windings 41*a*, 41*b* are flowed through in opposite directions by the total current of the two parallel-connected branch circuits. The second transformer Tr41 likewise operates as a differential current transformer. It causes a balancing of the total current directly upstream and downstream of the parallel connection of the two branch circuits. The losses owing to parasitic capacitances are thereby compensated such that the lamps L41 and L43 can also shine in the case of strong dimming just as brightly as the lamps L40 and L42.

In accordance with the fifth exemplary embodiment of the invention, the ballast serves to operate three low-pressure discharge lamps, in particular fluorescent lamps L50, L51, L52. The circuit arrangement of this ballast is illustrated schematically in FIG. 5. Two parallel-connected branch circuits are connected to the first terminal of the resonance capacitor C1 and to the first terminal of the half-bridge capacitor C2. Two series-connected fluorescent lamps L50, L51 are arranged in the first branch circuit.

Only one fluorescent lamp L52 is connected to the second branch circuit. Moreover, the ballast has a transformer Tr50 with two windings 50*a*, 50*b* with the same number of turns per unit length. The first winding 50*a* is connected to the first branch circuit, in series with the series connection of the low-pressure discharge lamps L50 and L51. The second winding 50*b* is connected to the second branch circuit, in series with the low-pressure discharge lamp L52. The two windings 50*a*, 50*b* are arranged in the branch circuits such that they are flowed through in opposite senses by the partial currents in the branch circuits. The transformer Tr50 acts as a differential current transformer and ensures a balancing of the partial currents in the two parallel-connected branch circuits. The ballast further has a second transformer Tr51 having two windings 51*a*, 51*b* with the same number of turns per unit length. The first winding 51*a* is arranged directly upstream of the parallel connection of the two branch circuits, and the second winding 51*b* is arranged directly downstream of the parallel connection of the two branch circuits, such that the two windings 51*a*, 51*b* are flowed through by the total current of the two parallel-connected branch circuits in opposite senses. The second transformer Tr51 likewise operates as a differential current transformer. It causes balancing of the total current directly upstream and downstream of the parallel connection of the two branch circuits.

In accordance with the sixth exemplary embodiment of the invention, the ballast serves for operating two low-pressure discharge lamps, in particular fluorescent lamps L60, L61. The circuit arrangement of this ballast is illustrated schematically in FIG. 6. Connected to the first terminal of the resonance capacitor C1 and to the first terminal of the half-bridge capacitor C2 are two parallel-connected branch circuits to which a low-pressure discharge lamp L60 or L61 is respectively connected. Moreover, the ballast has a transformer Tr60 having two windings 60*a*, 60*b* with the same number of turns per unit length. The first winding 60*a* is connected to the first branch circuit, in series with the discharge path of the low-pressure discharge lamp L60. The second winding 60*b* is connected to the second branch circuit, in series with the discharge path of the low-pressure discharge lamp L61. The two windings 60*a*, 60*b* are arranged in the branch circuits such that they are flowed through in opposite senses by the discharge currents of the lamps or the partial currents in the branch circuits. The transformer Tr60 acts as a differential current transformer and ensures a balancing of the partial currents in the two parallel-connected branch circuits. The ballast further has a second transformer Tr61 having two windings 61*a*, 61*b* with the same number of turns per unit length. The first winding 61*a* is connected directly upstream of the parallel connection of the two branch circuits, and the second winding 61*b* is connected directly downstream of the parallel connection of the two branch circuits, such that the two windings 61, 61*b* are flowed through in opposite senses by the total current of the two parallel-connected branch circuits. The second transformer Tr61 likewise operates as a differential current transformer. It causes a balancing of the total current directly upstream and downstream of the parallel connection of the two branch circuits. The losses owing to parasitic capacitances are thereby compensated such that the two ends of the lamps L60 and L61 shine equally brightly even in the case of strong dimming.

In accordance with the seventh exemplary embodiment of the invention, the ballast serves for operating two series-connected low-pressure discharge lamps, in particular fluorescent lamps L70, L71. The circuit arrangement of this ballast is illustrated schematically in FIG. 7. The series connection of the two fluorescent lamps L70, L71 is connected to the first terminal of the resonance capacitor C1 and to the first terminal of the half-bridge capacitor C2. The ballast also has a transformer Tr7 having two windings 7*a*, 7*b* with the same number of turns per unit length. Both windings 7*a*, 7*b* are connected in series with the series connection of the lamps L70, L71 such that they are flowed through by the lamp current in opposite directions. The first winding 8*a* is connected directly upstream of the series connection of the lamps L70, L71, and the second winding 7*b* is connected directly downstream of the series connection of the lamps L70, L71 to the load circuit of the half-bridge inverter T1, T2. The transformer Tr7 operates as a differential current transformer. It compensates the losses owing to parasitic capacitances.

In accordance with eighth exemplary embodiment of the invention, the ballast serves to operate a low-pressure discharge lamp, in particular a fluorescent lamp L8. The circuit arrangement of this ballast is illustrated schematically in FIG. 8. The discharge path of the lamp L8 is connected between the first terminal of the resonance capacitor C1 and the first terminal of the half-bridge capacitor C2 to the load circuit of the half-bridge inverter. The ballast also has a transformer Tr8 having two windings 8*a*, 8*b* with the same number of turns per unit length. The two windings 8*a*, 8*b* are connected in series with the discharge path of the lamp L8 such that they are flowed through by the lamp current in opposite directions. The first winding 8*a* is connected directly upstream of the discharge path of the lamp L8, and the second winding 8*b* is connected directly downstream of the discharge path of the lamp L8 to the load circuit of the half-bridge inverter T1, T2. The transformer Tr8 operates as a differential current transformer. It compensates the losses owing to parasitic capacitances and thereby ensures that the two ends of the fluorescent lamp L8 shine equally brightly even in the case of strong dimming.

What is claimed is:

1. A ballast for operating a plurality of low-pressure discharge lamps, the ballast having three parallel-connected branch circuits to which electric terminals for at least one low-pressure discharge lamp are connected, wherein the ballast has a first transformer for balancing the lamp currents, the first transformer has a first and a second winding, the first winding having twice as many turns as the second winding, the ballast has a second transformer for balancing the lamp currents, the second transformer having a first and a second winding, and the first winding having twice as many turns as the second winding, the windings of the transformers are arranged in such a way that when the low-pressure discharge lamps are connected the lamp currents flow firstly through the windings of one of the two transformers, then through the low-pressure discharge lamps and only then through the windings of the other transformer, the first winding of the first transformer is arranged in such a way that when the low-pressure discharge lamps are connected it is flowed through by the lamp current of the low-pressure discharge lamp or low-pressure discharge lamps connected to the first branch circuit, the second winding of the first transformer is arranged in such a way that, with the low-pressure discharge lamps connected, it is flowed through by the lamp currents of the low-pressure discharge lamps connected to the second and third branch circuit, the two windings of the first transformer (Tr10) being wound in opposite senses, the first winding of the second transformer is arranged in such a way that, with the low-pressure discharge lamps connected, it is flowed through by the lamp current of the low-pressure discharge lamp or low-pressure discharge lamps connected to the third branch circuit, and the second winding of the second transformer (Tr11) is arranged in such a way that, with the low-pressure discharge lamps connected, it is flowed through by the lamp currents of the low-pressure discharge lamps connected to the first and second branch circuit, the two windings of the second transformer being wound in opposite senses.

2. The ballast as claimed in claim 1, wherein the ballast is designed as an inverter with a downstream load circuit, the electric terminals for the low-pressure discharge lamps or the branch circuits with the electric terminals for at least one low-pressure discharge lamp being arranged in the load circuit.

3. The ballast as claimed in claim 1, wherein the inverter is designed as a half-bridge inverter having two switching transistors and one half-bridge capacitor, the load circuit is designed as a series resonant circuit having a resonance inductor and a resonance capacitor, in each case one terminal of the resonance capacitor and of the half-bridge capacitor is at frame potential, the second terminal of the resonance capacitor is connected via the resonance inductor to the center tap of the half-bridge inverter, and the branch circuits or the series connection or the electric terminals for the at least one low-pressure discharge lamp are switched between the second terminal of the resonance capacitor and the second terminal of the half-bridge capacitor.

4. A ballast for operating a plurality of low-pressure discharge lamps, the ballast having three parallel-connected branch circuits to which electric terminals for at least one low-pressure discharge lamp are connected, wherein the ballast has a transformer for balancing the lamp currents, the transformer has three identically constructed and isotropically arranged windings that are arranged in each case in one of the branch circuits such that they are flowed through by the lamp current in the same sense, and at least one of the three parallel-connected branch circuits has electric terminals for a series circuit of a plurality of low-pressure discharge lamps, and the ballast has a second transformer with two windings with the same number of turns per unit length for the purpose of balancing the lamp currents, the first winding of the second transformer being arranged upstream of the parallel connection of the three branch circuits, and the second winding being arranged downstream of the parallel connection of the three branch circuits, such that, with the low-pressure discharge lamps connected, the two windings of the second transformer are flowed through by the total current of the branch circuits in the opposite sense.

5. The ballast as claimed in claim 4, wherein the ballast is designed as an inverter with a downstream load circuit, the electric terminals for the low-pressure discharge lamps or the branch circuits with the electric terminals for at least one low-pressure discharge lamp being arranged in the load circuit.

6. A ballast for operating a plurality of low-pressure discharge lamps, the ballast having a transformer for balancing the lamp currents, the ballast having two parallel-connected branch circuits to which electric terminals for at least one low-pressure discharge lamp are connected in each case, the transformer having a first winding that is connected to the first branch circuit, and having a second winding with the same number of turns that is connected to the second branch circuit with the opposite winding sense, wherein the ballast has a second transformer for balancing the lamp currents, the second transformer has a first and a second winding with the same number of turns per unit length, the first winding being arranged upstream of the parallel connection of the branch circuits, and the second winding being arranged downstream of the parallel connection of the branch circuits, and the first and the second windings of the second transformer are arranged in such a way that, with the low-pressure discharge lamps connected, they are flowed through in the opposite sense by the total current of the parallel connection of the branch circuits.

7. The ballast as claimed in claim 6, wherein the ballast is designed as an inverter with a downstream load circuit, the electric terminals for the low-pressure discharge lamps or the branch circuits with the electric terminals for at least one low-pressure discharge lamp being arranged in the load circuit.

8. The ballast as claimed in claim 6, wherein the first and the second branch circuits in each case have electric terminals for two low-pressure discharge lamps to be connected in series.

9. The ballast as claimed in claim 8, wherein the ballast is designed as an inverter with a downstream load circuit, the electric terminals for the low-pressure discharge lamps or the branch circuits with the electric terminals for at least one low-pressure discharge lamp being arranged in the load circuit.

10. The ballast as claimed in claim 4, wherein the first branch circuit has electric terminals for the series connection of two low-pressure discharge lamps, and the second branch circuit has electric terminals for one low-pressure discharge lamp.

11. The ballast as claimed in claim 10, wherein the ballast is designed as an inverter with a downstream load circuit, the electric terminals for at least one low-pressure discharge lamps or the branch circuits with the electric terminals for at least one low-pressure discharge lamp being arranged in the load circuit.

* * * * *